US009837063B1

(12) United States Patent
Feese

(10) Patent No.: US 9,837,063 B1
(45) Date of Patent: Dec. 5, 2017

(54) PICKUP COIL SENSORS AND METHODS FOR ADJUSTING FREQUENCY RESPONSE CHARACTERISTICS OF PICKUP COIL SENSORS

(71) Applicant: Michael David Feese, Seattle, WA (US)

(72) Inventor: Michael David Feese, Seattle, WA (US)

( * ) Notice: Subject to any disclaimer, the term of this patent is extended or adjusted under 35 U.S.C. 154(b) by 0 days.

(21) Appl. No.: 15/002,400

(22) Filed: Jan. 21, 2016

(51) Int. Cl.
*G10H 3/22* (2006.01)
*G10H 3/18* (2006.01)

(52) U.S. Cl.
CPC ..... *G10H 3/181* (2013.01); *G10H 3/22* (2013.01); *G10H 2220/515* (2013.01)

(58) Field of Classification Search
CPC ..... G10H 3/22; G10H 3/181; G10H 2220/515
USPC ..... 84/725, 726
See application file for complete search history.

(56) References Cited

U.S. PATENT DOCUMENTS

| | | | |
|---|---|---|---|
| 2,087,106 | A | 7/1937 | Hart |
| 2,089,171 | A | 8/1937 | Beauchamp |
| 2,262,335 | A | 11/1941 | Russell |
| 2,293,372 | A | 8/1942 | Vasilach |
| 2,294,861 | A | 9/1942 | Fuller |
| 2,455,046 | A | 11/1948 | Armond |
| 2,557,754 | A | 8/1951 | Morrison |
| 2,612,072 | A | 9/1952 | Armond |
| 2,683,388 | A | 7/1954 | Keller |
| 2,892,371 | A | 6/1959 | Butts |
| 2,896,491 | A | 7/1959 | Lover |
| 2,909,092 | A | 10/1959 | Armond et al. |
| 2,911,871 | A | 11/1959 | Schultz |
| 2,964,985 | A | 12/1960 | Webster |
| 3,066,567 | A | 12/1962 | Kelley |
| 3,147,332 | A | 9/1964 | Fender |
| 3,177,283 | A | 4/1965 | Fender |
| 3,236,930 | A | 2/1966 | Fender |
| 3,249,677 | A | 5/1966 | Burns et al. |
| 3,483,303 | A | 12/1969 | Warner |
| 3,535,968 | A | 10/1970 | Rickard |
| 3,541,219 | A | 11/1970 | Abair |
| 3,544,696 | A | 12/1970 | Broussard et al. |

(Continued)

OTHER PUBLICATIONS

Coillot, Christophe, et al., "Induction Magnetometers Principle, Modeling and Ways of Improvement" Magnetic Sensors—Principles and Applications, Dr. Kevin Kuang (Ed.) ISBN: 978-953-51-0232-8, InTech (2012) 21 Pgs.

(Continued)

*Primary Examiner* — David Warren
(74) *Attorney, Agent, or Firm* — Wells St. John P.S.

(57) ABSTRACT

Coils for receiving or transmitting electromagnetic signals comprising a plurality of concurrently wound and fully or partially interpenetrating windings for which the resonance frequency can be varied over a broad range. The presently described embodiments provide for electromagnetic pickups for stringed musical instruments; however, it is appreciated that other embodiments providing for a wide variety of devices comprising pickup coil sensors are apparent. It is also apparent that a wide variety of devices are possible in which coils with concurrently wound and interpenetrating windings will serve as transmitting coils.

19 Claims, 4 Drawing Sheets

(56) References Cited

U.S. PATENT DOCUMENTS

| | | | | |
|---|---|---|---|---|
| 3,571,483 | A | 3/1971 | Davidson | |
| 3,588,311 | A | 6/1971 | Zoller | |
| 3,629,483 | A | 12/1971 | Welch | |
| 3,657,461 | A | 4/1972 | Freeman | |
| 3,711,619 | A | 1/1973 | Jones et al. | |
| 3,715,446 | A | 2/1973 | Kosinski | |
| 3,983,778 | A | 10/1976 | Bartolini | |
| 4,372,186 | A * | 2/1983 | Aaroe | G10H 3/181 84/725 |
| 4,501,185 | A | 2/1985 | Blucher | |
| 4,545,278 | A | 10/1985 | Gagon et al. | |
| 5,376,754 | A * | 12/1994 | Stich | G10H 3/182 84/728 |
| 5,408,043 | A * | 4/1995 | Lace | G10H 3/181 84/726 |
| 6,476,309 | B2 * | 11/2002 | Gaglio | G10H 3/181 84/726 |
| 6,846,981 | B2 | 1/2005 | Devers | |
| D517,114 | S | 3/2006 | Knaggs et al. | |
| 7,022,909 | B2 | 4/2006 | Kinman | |
| 7,189,916 | B2 | 3/2007 | Kinman | |
| 7,288,713 | B2 | 10/2007 | Krozack et al. | |
| 7,612,282 | B1 * | 11/2009 | Lawing | G10H 3/181 84/725 |
| 7,989,690 | B1 * | 8/2011 | Lawing | G10H 3/181 84/723 |
| 8,319,088 | B1 * | 11/2012 | Harari | G10H 3/181 84/727 |
| 8,519,251 | B2 | 8/2013 | Lingel | |
| 8,791,351 | B2 * | 7/2014 | Kinman | G10H 3/181 84/723 |
| 8,802,959 | B2 * | 8/2014 | Mills | G10H 3/181 84/726 |
| 8,946,537 | B2 * | 2/2015 | Yaron | G10H 3/143 84/727 |
| 9,704,464 | B1 * | 7/2017 | Petschulat | G10H 3/181 |
| 2002/0020281 | A1 * | 2/2002 | Devers | G10H 3/181 84/728 |
| 2002/0073829 | A1 * | 6/2002 | Gaglio | G10H 3/181 84/726 |
| 2002/0073830 | A1 * | 6/2002 | Petherick | G10H 3/181 84/726 |
| 2002/0083819 | A1 | 7/2002 | Kinman | |
| 2005/0150364 | A1 | 7/2005 | Krozack et al. | |
| 2005/0150365 | A1 | 7/2005 | Krozack et al. | |
| 2006/0112816 | A1 | 6/2006 | Kinman | |
| 2010/0122623 | A1 * | 5/2010 | Salo | G10H 3/181 84/726 |
| 2012/0103170 | A1 * | 5/2012 | Kinman | G10H 3/181 84/726 |
| 2012/0118129 | A1 * | 5/2012 | Jang | G10H 3/143 84/726 |
| 2013/0239788 | A1 * | 9/2013 | Mills | G10H 3/181 84/726 |
| 2013/0312591 | A1 * | 11/2013 | Mills | G10H 3/181 84/726 |
| 2013/0327202 | A1 * | 12/2013 | Mills | G10H 3/181 84/726 |
| 2014/0373701 | A1 * | 12/2014 | Yaron | G10H 3/143 84/726 |

OTHER PUBLICATIONS

Tumanski, S., "Induction Coil Sensors—a Review", Measurement Science and Technology 18 (2007) 14 pgs.

* cited by examiner

FIG.7
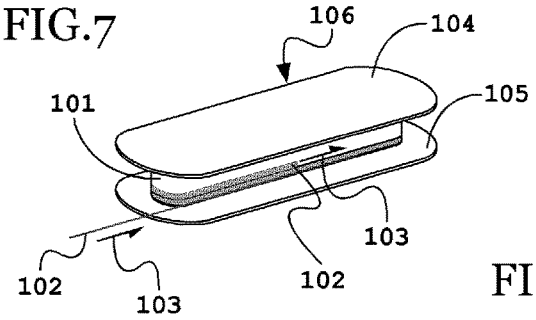
FIG.8
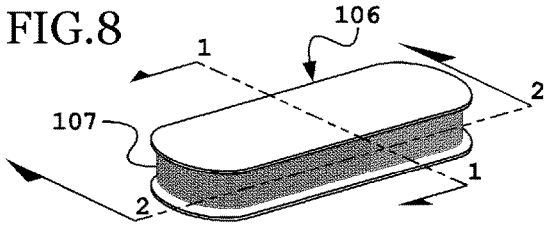
FIG.9
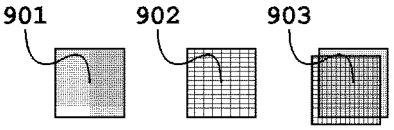
FIG.10A
FIG.10B
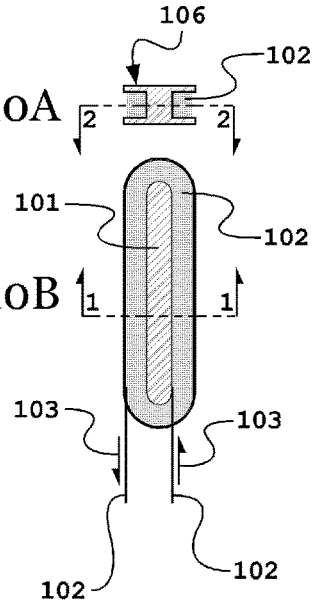
FIG.11A
FIG.11B
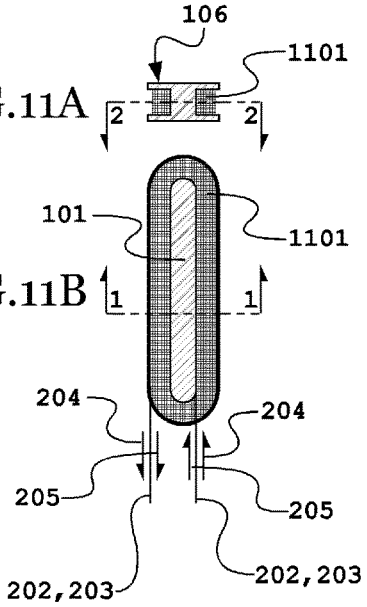

FIG.12A
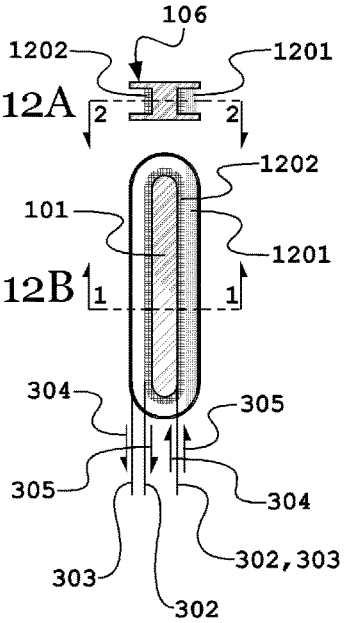
FIG.12B
FIG.13A
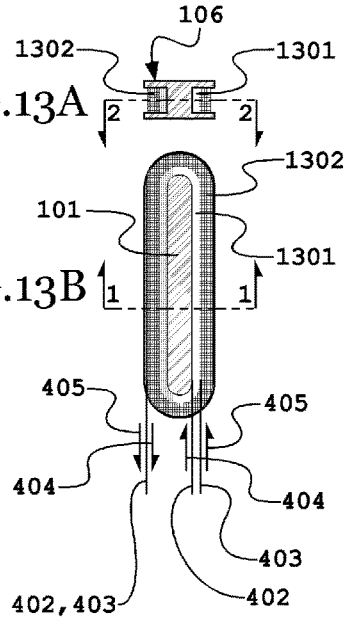
FIG.13B
FIG.14A
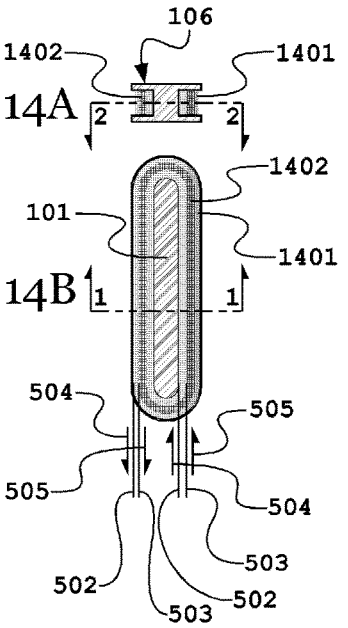
FIG.14B
FIG.15A
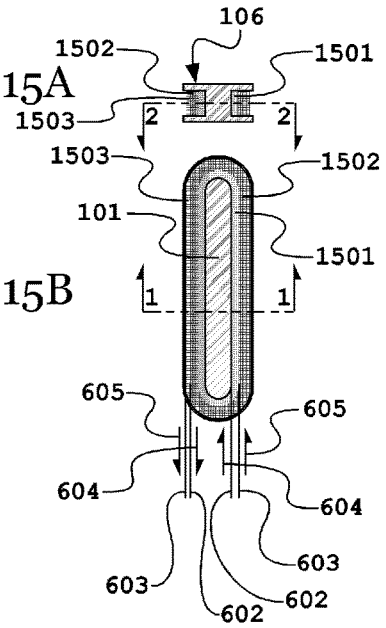
FIG.15B

PICKUP COIL SENSORS AND METHODS FOR ADJUSTING FREQUENCY RESPONSE CHARACTERISTICS OF PICKUP COIL SENSORS

BACKGROUND ART

The frequency response of a pickup coil sensor in an electromagnetic pickup (also known as an induction coil sensor, induction sensor, search coil sensor, pickup coil sensor, or magnetic loop sensor), especially its resonance frequency, is an important determinant of the timbre of amplified sound transferred from vibrating ferromagnetic strings. The resonance frequency is largely a function of the internal resistance, inductance, and self-capacitance of the coil. These properties depend upon the geometry of the coil, the number and density of turns in the winding, and gauge of wire. Heretofore, electromagnetic pickups for stringed musical instruments have comprised one or more coils, each of which is wound with a single strand of wire (referred to as a single-winding coil). The resonance frequency of an electromagnetic guitar pickup, for example, typically lies within the range of 4,000 to greater than 20,000 Hertz. However, the fundamental frequencies of notes on the guitar fret board range from ~80 Hertz (open sixth string E) to ~1318 Hertz (first string E at the $24^{th}$ fret), and the frequencies of the corresponding musically important overtones are mostly less than 4,000 Hertz.

Electromagnetic pickups referred to commonly as 'single coil' as disclosed in U.S. Pat. No. 2,087,106 (HART) Jun. 13, 1937 and U.S. Pat. No. 2,089,171 (BEAUCHAMP) Aug. 10, 1937 comprise a single-winding coil (as shown schematically in FIG. 1 and depicted in cross-sectional views in FIG. 10A-10B) in which the winding is disposed about one or more ferromagnetic or permanent magnet pole pieces. Electromagnetic pickups comprising two or more coils (as disclosed in U.S. Pat. No. 2,892,371 (BUTTS) Jun. 30, 1959 and U.S. Pat. No. 2,896,491 (LOVER) Jul. 28, 1959) employ several single-winding coils disposed side-by-side and electrically connected in series or in parallel, often with their magnetic field vectors arranged anti-parallel in order to provide at least partial cancellation of unwanted signal due to external electromagnetic transmissions and main power alternating current. Variations of the two-coil electromagnetic pickup in which one of the single-winding coils is wound with a different gauge of wire (as disclosed in U.S. Pat. No. 4,501,185 (BLUCHER) Feb. 26, 1985) or wound with significantly more turns of wire (commonly referred to as 'unbalanced' or ' mismatched' coils) provide for altered timbre of amplified sound due to the coils having different resonance frequencies. Other embodiments of two-coil electromagnetic pickups comprise several single-winding coils that are stacked one atop another (as disclosed in U.S. Pat. No. 3,657,461 (FREEMAN) Apr. 18, 1972) or nested within each other (as disclosed in U.S. Pat. No. 3,711,619 (JONES) Jan. 16, 1973).

Present embodiments provide for the construction of pickup coil sensors comprising a plurality of concurrently wound and fully or partially interpenetrating windings for which the resonance frequency can be varied over a broad range and can be adjusted to emphasize certain frequency regimes. I have found that 1) such coils, whether each winding is used individually or they are connected in series or in parallel, have resonance frequencies that are appreciably different from single-winding pickup coil sensors with the same or similar geometry and similar total number of turns in the winding, and 2) that the frequency response characteristics of such coils can be adjusted by altering the number of turns in each winding, the degree of interpenetration of the windings, and the region within the coil where the interpenetration occurs. In FIG. 17 the frequency response profile for an example of this type of pickup coil sensor is shown for the case in which primary and secondary windings each of ~2,500 turns of 42 AWG wire are concurrently wound and fully interpenetrating (as shown schematically in FIG. 2 and depicted in cross-sectional views in FIG. 11A-11B) and electrically connected in series 1703 or in parallel 1704. When the primary and secondary windings are connected in parallel a resonance frequency at ~19,322 Hertz is observed. When the primary and secondary windings are connected in series a resonance frequency at ~1,363 Hertz is observed. The frequency response profiles for two single-winding pickup coil sensors (as shown schematically in FIG. 1 and depicted in cross-sectional views in FIG. 10A-10B) 1701 with ~2,500 turns of 42 AWG wire (resonance frequency at ~17,804 Hertz) and 1702 with ~5,000 turns of 42 AWG wire (resonance frequency at ~9,907 Hertz) are also shown in FIG. 17. A pickup coil sensor with concurrently wound and interpenetrating windings can be combined with another such pickup coil sensor or with a single-winding pickup coil sensor to form a two-coil combination with a distinct frequency response profile. In FIG. 18 the frequency response profile for this type of two-coil combination 1803 is shown in which a pickup coil sensor (as shown schematically in FIG. 2 and depicted in cross-sectional views in FIG. 11A-11B) comprising primary and secondary windings each of ~2,500 turns of 42 AWG wire and in which said windings are connected in series is in turn connected in series with a single-winding pickup coil sensor (as shown schematically in FIG. 1 and depicted in cross-sectional views in FIG. 10A-10B) with ~5,000 turns of 42 AWG wire. The frequency response profiles for the single-winding pickup coil sensor 1801 and the two wire concurrently wound and interpenetrating pickup coil sensor 1802 comprised by the two-coil combination are also shown in FIG. 18.

The embodiments comprise:

1. A plurality of wires
2. of the same or different gauge
3. that are wound concurrently (in right-handed or left-handed fashion),
4. with or without one or more ferromagnetic pole pieces, magnets, or other material in the core region,
5. with the same or different number of turns,
6. to form fully or partially interpenetrating windings
7. that can be connected in series,
8. in parallel,
9. in phase or out of phase, or
10. connected independently in a circuit or circuits, or
11. not connected in a circuit.

The following is a tabulation of some prior art that presently appears relevant:

TABLE 1

| Relevant Prior Art | | |
|---|---|---|
| Pat. No. | Issue Date | Patentee |
| 8,519,251 | August 2013 | Lingel |
| 7,288,713 | October 2007 | Krozack, et al. |
| 7,189,916 | March 2007 | Kinman |
| 7,022,909 | April 2007 | Kinman |
| 6,846,981 | January 2005 | Devers |
| 4,545,278 | October 2005 | Gagon, et al. |

TABLE 1-continued

| Relevant Prior Art | | |
|---|---|---|
| Pat. No. | Issue Date | Patentee |
| 4,501,185 | Feburary 1985 | Blucher |
| 3,983,778 | October 1976 | Bartolini |
| 3,715,446 | Feburary 1973 | Kosinski |
| 3,711,619 | January 1973 | Jones, et al. |
| 3,657,461 | April 1972 | Freeman |
| 3,629,483 | December 1971 | Welch |
| 3,588,311 | June 1971 | Zoller |
| 3,571,483 | March 1971 | Davidson |
| 3,541,219 | November 1970 | Abair |
| 3,535,968 | October 1970 | Rickard |
| 3,483,303 | December 1969 | Warner |
| 3,249,677 | May 1966 | Burns, et al. |
| 3,236,930 | Feburary 1966 | Fender |
| 3,177,283 | April 1965 | Fender |
| 3,147,332 | September 1964 | Fender |
| 3,066,567 | December 1962 | Kelley |
| 2,911,871 | November 1959 | Schultz |
| 2,909,092 | October 1959 | De Armond, et al. |
| 2,896,491 | July 1959 | Lover |
| 2,892,371 | June 1959 | Butts |
| 2,683,388 | July 1954 | Keller |
| 2,612,072 | September 1952 | De Armond |
| 2,557,754 | June 1951 | Morrison |
| 2,294,861 | September 1942 | Fuller |
| 2,293,372 | August 1942 | Vasilach |
| 2,262,335 | November 1941 | Russell |
| 2,089,171 | August 1937 | Beauchamp |
| 2,087,106 | July 1937 | Hart |

BRIEF DESCRIPTION OF THE DRAWINGS

The foregoing and other objects, features, and advantages will become apparent from the following description of present embodiments in conjunction with the accompanying drawings, of which there are four sheets, in which:

FIG. 7 is a perspective view of a general form of a pickup coil bobbin 106 comprising a core 101, an upper flange 104 and a lower flange 105. A partial winding 102 is depicted, with arrows 103 showing the counter-clockwise direction of winding when viewed from the top. Clockwise winding is also equally applicable to pickup coil sensors.

FIG. 8 is a perspective view of a general form of a pickup coil sensor comprising a bobbin 106 and a coil 107.

FIG. 9 shows the depiction used for the primary winding 901, the depiction used for the secondary winding 902, and the depiction used for the region of interpenetration of the primary and secondary windings 903 that are used in FIGS. 10-15.

FIG. 10A is a cross-sectional view of a single-winding pickup coil sensor as depicted in FIG. 1 taken along the section 1-1 of FIG. 8. Refer to FIG. 9 for conventions regarding the depiction of the windings.

FIG. 10B is a cross-sectional view of a single-winding pickup coil sensor as depicted in FIG. 1 taken along the section 2-2 of FIG. 8. Refer to FIG. 9 for conventions regarding the depiction of the windings.

FIG. 11A is a cross-sectional view of a two-winding pickup coil sensor as depicted in FIG. 2 taken along the section 1-1 of FIG. 8. Refer to FIG. 9 for conventions regarding the depiction of the windings.

FIG. 11B is a cross-sectional view of a two-winding pickup coil sensor as depicted in FIG. 2 taken along the section 2-2 of FIG. 8. Refer to FIG. 9 for conventions regarding the depiction of the windings.

FIG. 12A is a cross-sectional view of a two-winding pickup coil sensor as depicted in FIG. 3 taken along the section 1-1 of FIG. 8. Refer to FIG. 9 for conventions regarding the depiction of the windings.

FIG. 12B is a cross-sectional view of a two-winding pickup coil sensor as depicted in FIG. 3 taken along the section 2-2 of FIG. 8. Refer to FIG. 9 for conventions regarding the depiction of the windings.

FIG. 13A is a cross-sectional view of a two-winding pickup coil sensor as depicted in FIG. 4 taken along the section 1-1 of FIG. 8. Refer to FIG. 9 for conventions regarding the depiction of the windings.

FIG. 13B is a cross-sectional view of a two-winding pickup coil sensor as depicted in FIG. 4 taken along the section 2-2 of FIG. 8. Refer to FIG. 9 for conventions regarding the depiction of the windings.

FIG. 14A is a cross-sectional view of a two-winding pickup coil sensor as depicted in FIG. 5 taken along the section 1-1 of FIG. 8. Refer to FIG. 9 for conventions regarding the depiction of the windings.

FIG. 14B is a cross-sectional view of a two-winding pickup coil sensor as depicted in FIG. 5 taken along the section 2-2 of FIG. 8. Refer to FIG. 9 for conventions regarding the depiction of the windings.

FIG. 15A is a cross-sectional view of a two-winding pickup coil sensor as depicted in FIG. 6 taken along the section 1-1 of FIG. 8. Refer to FIG. 9 for conventions regarding the depiction of the windings.

FIG. 15B is a cross-sectional view of a two-winding pickup coil sensor as depicted in FIG. 6 taken along the section 2-2 of FIG. 8. Refer to FIG. 9 for conventions regarding the depiction of the windings.

MODE(S) FOR CARRYING OUT THE INVENTION

Figure 2:
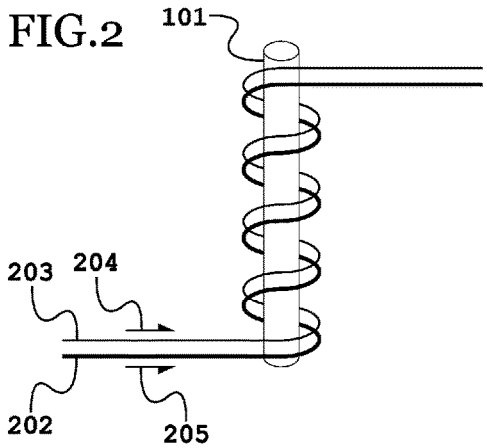
FIG. 2 is a schematic diagram of a pickup coil sensor comprising a core 101, a primary winding 202, and a secondary winding 203 in which the primary and secondary windings are concurrently wound and fully interpenetrating.

A first embodiment is shown schematically in FIG. 2 and depicted in cross-sectional views in FIG. 11A-11B. This embodiment comprises a primary winding 202 and a secondary winding 203 in which said primary and secondary windings are concurrently wound and fully interpenetrating and in which said primary and secondary windings are of the same or different gauge, with or without one or more ferromagnetic pole pieces, magnets, or other material in the core region.

Figure 3:
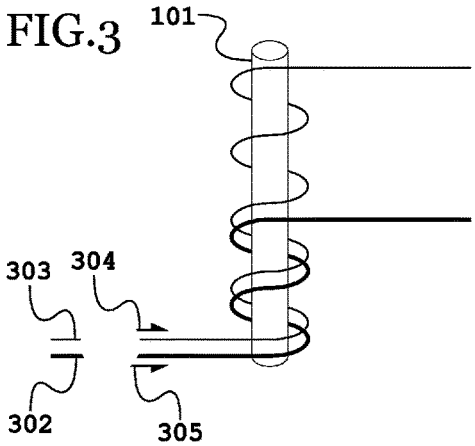
FIG. 3 is a schematic diagram of a pickup coil sensor comprising a core 101, a primary winding 302, and a secondary winding 303 in which the primary and secondary windings are concurrently wound and partially interpenetrating and in which the region of interpenetration begins at the start of the windings and ends in the midst of the primary winding 302.

A second embodiment is shown schematically in FIG. 3 and depicted in cross-sectional views in FIG. 12A-12B. This embodiment comprises a primary winding 302 and a secondary winding 303 in which said primary and secondary windings are concurrently wound and partially interpenetrating and in which the region of interpenetration begins at the start of the windings and ends in the midst of the primary winding 302 and in which said primary and secondary windings are of the same or different gauge, with or without one or more ferromagnetic pole pieces, magnets, or other material in the core region.

Figure 4:
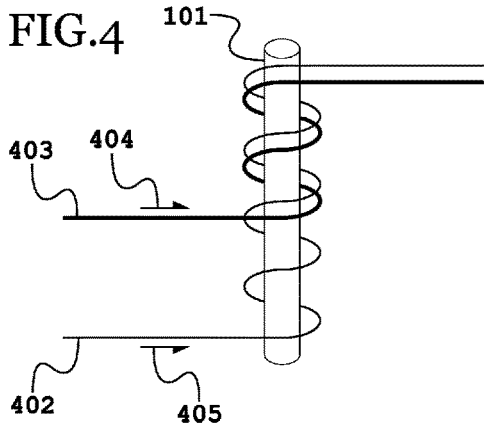
FIG. 4 is a schematic diagram of a pickup coil sensor comprising a core 101, a primary winding 402, and a secondary winding 403 in which the primary and secondary windings are concurrently wound and partially interpenetrating and in which the region of interpenetration begins in the midst of the primary winding 402 and continues to the end of the windings.

A third embodiment is shown schematically in FIG. 4 and depicted in cross-sectional views in FIG. 13A-13B. This embodiment comprises a primary winding 402 and a secondary winding 403 in which said primary and secondary windings are concurrently wound and partially interpenetrating and in which the region of interpenetration begins in the midst of the primary winding 402 and continues to the end of the windings and in which said primary and secondary windings are of the same or different gauge, with or without one or more ferromagnetic pole pieces, magnets, or other material in the core region.

Figure 5:
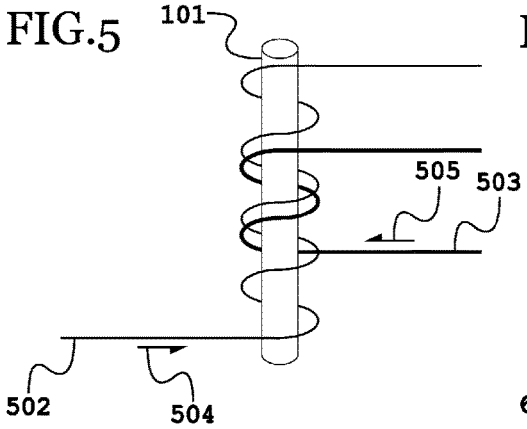
FIG. 5 is a schematic diagram of a pickup coil sensor comprising a core 101, a primary winding 502, and a secondary winding 503 in which the primary and secondary windings are concurrently wound and partially interpenetrating and in which the region of interpenetration begins and ends in the midst of the primary winding 502.

A fourth embodiment is shown schematically in FIG. 5 and depicted in cross-sectional views in FIG. 14A-14B. This embodiment comprises a primary winding 502 and a secondary winding 503 in which said primary and secondary windings are concurrently wound and partially interpenetrating and in which the region of interpenetration begins and ends in the midst of the primary winding 502 and in which said primary and secondary windings are of the same or different gauge, with or without one or more ferromagnetic pole pieces, magnets, or other material in the core region.

Figure 6:
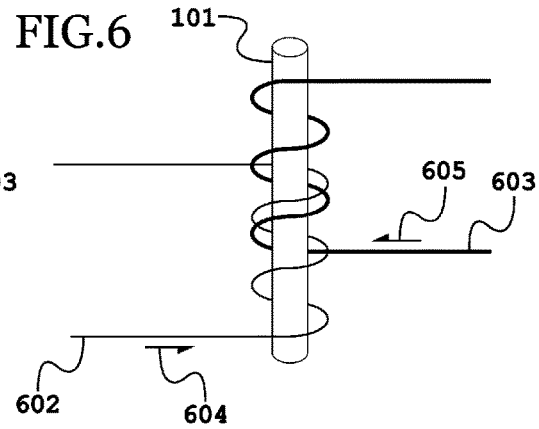
FIG. 6 is a schematic diagram of a pickup coil sensor comprising a core 101, a primary winding 602, and a secondary winding 603 in which the primary and secondary windings are concurrently wound and partially interpenetrating and in which the region of interpenetration begins in the midst of the primary winding 602 and ends in the midst of the secondary winding 603.
Figure 16:
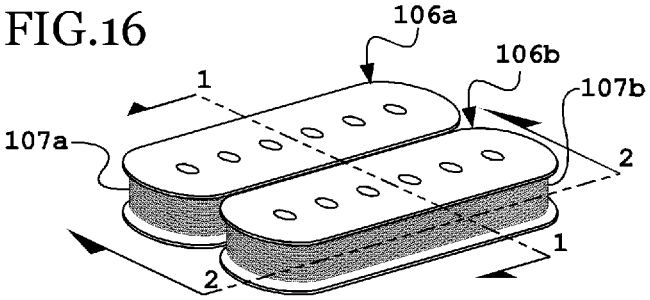
FIG. 16 is a perspective view of a general form of a two-coil pickup coil sensor comprising two bobbins (106*a* and 106*b*), and two coils (107*a* and 107*b*).
Figure 17:
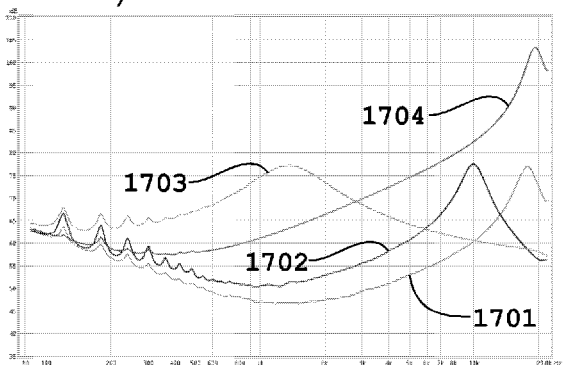
FIG. 17 is an overlay of frequency response profiles for pickup coil sensors as depicted in FIG. 10A-10B comprising windings of ~2,500 turns 1701 and ~5,000 turns 1702 of 42 AWG enameled copper wire and a pickup coil sensor as depicted in FIG. 11A-11B comprising primary and secondary windings each of ~2,500 turns of 42 AWG enameled copper wire in which said windings are connected in series 1703 or in parallel 1704.
Figure 18:
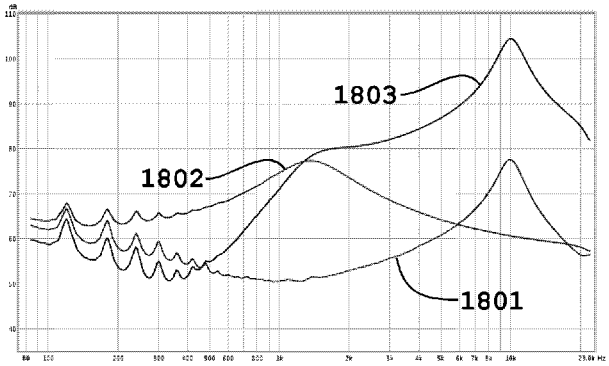
FIG. 18 is an overlay of frequency response profiles for a pickup sensor coil as depicted in FIG. 10A-10B comprising a winding of ~5,000 turns 1801 of 42 AWG enameled copper wire, a pickup sensor coil as depicted in FIG. 11A-11B comprising primary and secondary windings each of ~2,500 turns of 42 AWG enameled copper wire in which the windings are connected in series 1802, and a two-coil pickup coil sensor as depicted in FIG. 16 comprising the pickup sensor coils represented by frequency response curves 1801 and 1802 in which the pickup coil sensors are connected in series 1803.

A fifth embodiment is shown schematically in FIG. 6 and depicted in cross-sectional views in FIG. 15A-15B. This embodiment comprises a primary winding 602 and a secondary winding 603 in which said primary and secondary windings are concurrently wound and partially interpenetrating and in which the region of interpenetration begins in the midst of the primary winding 602 and ends in the midst of the secondary winding 603 and in which said primary and secondary windings are of the same or different gauge, with or without one or more ferromagnetic pole pieces, magnets, or other material in the core region.

Figure 1:
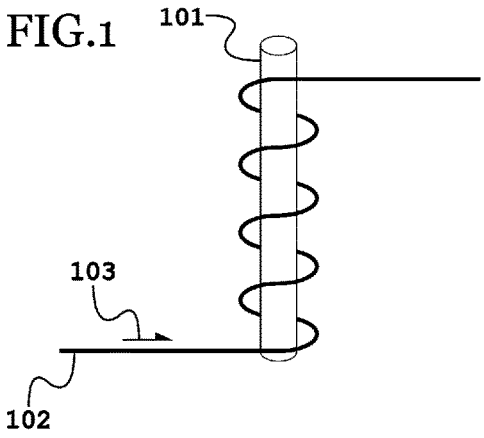
FIG. 1 is a schematic diagram of a single-winding pickup coil sensor comprising a core 101 and a winding 102.

An additional set of five embodiments is illustrated by combination of one single-winding pickup coil sensor (as shown schematically in FIG. 1 and depicted in cross-sectional views in FIG. 10A-10B) and another coil of the type of one of the first to fifth embodiments described hereinabove to form a two-coil electromagnetic pickup of either a side-by-side or stacked configuration.

An additional set of twenty-five embodiments is illustrated by the various possible combinations of one coil of the type of one of the first to fifth embodiments described hereinabove and another coil of the type of one of the first to fifth embodiments described hereinabove to form a two-coil electromagnetic pickup of either a side-by-side or stacked configuration.

Embodiments described herein above comprise concurrently wound and interpenetrating coils employing two windings. However, it is apparent that concurrently wound coils comprising three or more interpenetrating windings will have additional utility in creating desirable frequency response characteristics.

Embodiments described herein above comprise one or two coils. However, the usefulness of embodiments in the form of pickup coil sensors with three or more coils variously connected (or not connected) in the manners described herein above is apparent.

It is generally known that a coil that serves as a sensor can be employed as a transmitter. Thus coils comprising a plurality of concurrently wound and fully or partially interpenetrating windings as described herein with their attendant characteristics have equally useful embodiments as transmitting coils. Such coils are suitable for transmission and reception of wireless signals for digital signals (such as wireless internet connections and communication between peripheral devices such as printers and cameras) and analogue signals (such as sound for wireless speakers, radio, or cochlear implants), field generation or sensing for magnetic resonance imaging, and for power transmission (such as in transformers or wireless chargers for cellular telephones and other rechargeable devices).

It is understood that variations and modifications can be effected within the scope and spirit of the embodiments described hereinabove and as defined in the appended claims and their legal equivalents.

REFERENCES

Slawomir Tumanski, "Induction Coil sensors—a review," Measurement Science and Technology 18 (2007) R31-R46

Christophe Coillot and Paul Leroy (2012). Induction Magnetometers Principle, Modeling and Ways of Improvement, Magnetic Sensors—Principles and Applications, Dr Kevin Kuang (Ed.), ISBN: 978-953-51-0232-8

The invention claimed is:

1. A pickup coil sensor comprising:

a plurality of windings comprising partially and secondary windings wound concurrently to form a region of partially interpenetrating windings; and the region of the partially interpenetrating windings beginning in the midst of the primary windings.

2. A sensor as in claim 1 wherein the primary and secondary windings are of the same gauge.

3. A sensor as in claim 1 wherein the primary and secondary windings are of different gauges.

4. A sensor as in claim 1, wherein the individual windings of the primary and secondary windings have a different number of turns.

5. A sensor as in claim 1 wherein the region of the partially interpenetrating windings terminates at one end of the plurality of the windings.

6. A sensor as in claim 1 wherein the region of the partially interpenetrating windings terminates in the midst of the primary windings.

7. A sensor as in claim 1 wherein the region of the partially interpenetrating windings terminates in the midst of the secondary windings.

8. A pickup coil sensor comprising:

a core;

a primary winding at least partially surrounding the core;

a secondary winding at least partially surrounding the core; and a region comprising the primary and secondary windings being at least partially interpenetrating, at least one of a beginning and an ending of the region being in the midst of one of the primary and secondary windings.

9. The sensor of claim 8 wherein the region begins at the start of the primary and secondary windings.

10. The sensor of claim 8 wherein the region begins in the midst of the primary winding.

11. The sensor of claim 8 wherein the region ends in the midst of the secondary winding.

12. The sensor of claim 8 wherein the region ends in the midst of the primary winding.

13. The sensor of claim 8 wherein the region begins and ends in the midst of the primary winding.

14. The sensor of claim 8 wherein the region begins at the start of the primary and secondary windings and ends in the midst of the primary winding.

15. The sensor of claim 8 wherein the region begins in the midst of the primary winding and ends at the end of the primary and secondary windings.

16. The sensor of claim 8 wherein the region begins in the midst of the primary winding and ends in the midst of the secondary winding.

17. A method for adjusting the frequency response characteristics of a pickup coil sensor, the method comprising:

providing a pickup coil sensor comprising primary and second windings that establish a region of at least partially interpenetrating;

adjusting the frequency response characteristics of the pickup coil sensor by performing at least one of the following:

altering the number of turns in each of the primary and secondary windings;

altering the degree of interpenetration in the region; and altering the position where the region of the interpenetration occurs in the pickup coil sensor.

18. The method of claim 17 wherein the adjusting comprises altering the degree of interpenetration in the region.

19. The method of claim 17 wherein the adjusting comprises altering the position where the region of the interpenetration occurs in the pickup coil sensor.

* * * * *